US007857307B2

(12) United States Patent
Tamura et al.

(10) Patent No.: US 7,857,307 B2
(45) Date of Patent: Dec. 28, 2010

(54) SHEET ACCUMULATION APPARATUS AND IMAGE FORMING SYSTEM HAVING SAME

(75) Inventors: Hitoshi Tamura, Tokyo (JP); Toshio Shida, Tokyo (JP); Hiroto Akiyama, Chuo (JP)

(73) Assignees: Konica Minolta Business Technologies, Icn., Tokyo (JP); Nisca Corporation, Minamikoma-Gun, Yamanashi (JP)

( * ) Notice: Subject to any disclaimer, the term of this patent is extended or adjusted under 35 U.S.C. 154(b) by 384 days.

(21) Appl. No.: 11/905,014

(22) Filed: Sep. 27, 2007

(65) Prior Publication Data

US 2009/0179375 A1 Jul. 16, 2009

(30) Foreign Application Priority Data

Oct. 13, 2006 (JP) ..... 2006-279887

(51) Int. Cl.
*B65H 31/20* (2006.01)

(52) U.S. Cl. ..... 271/224; 271/223

(58) Field of Classification Search ..... 271/223, 271/224, 220, 187, 194
See application file for complete search history.

(56) References Cited

U.S. PATENT DOCUMENTS 5,848,320 A * 12/1998 Yaginuma et al. ..... 399/45
5,966,852 A * 10/1999 Drzewiecki ..... 40/360
7,290,764 B2 * 11/2007 Marasco ..... 271/145
7,300,053 B2 * 11/2007 Asano ..... 271/224
7,427,064 B2 * 9/2008 Forch et al. ..... 271/204
7,500,669 B2 * 3/2009 Mandel ..... 271/227

FOREIGN PATENT DOCUMENTS

JP 2003-341908 12/2003
JP 2004284710 A * 10/2004

* cited by examiner

*Primary Examiner*—Kaitlin S Joerger
(74) *Attorney, Agent, or Firm*—Manabu Kanesaka

(57) ABSTRACT

The invention is to provide a sheet accumulation apparatus enabling to uniformly load tabbed sheets into a train of sheets for load and store the sheets on a tray. The sheet accumulation apparatus has a sheet outlet for successively discharging the sheets, a tray means for loading to hold the sheets thereon, a sheet carrier means for discharging the sheets from the sheet outlet to the side of a downstream, a sheet front end regulating means for colliding the sheets sent by the sheet carrier means against the regulating means at the sheet front ends and regulating them, and a sheet rear regulating means disposed to the tray means for regulating the positions of the sheets from the sheet outlet at the sheet rear ends. The sheet front end regulating means comprises (1) stopper member movable back and forth in the sheet carrying direction; or (2) stopper means of two or more disposed back and forth in the sheet carrying direction and selectively facing the sheet front end regulating means; or (3) stopper means movable in a direction traversing with carrying along the sheet head ends; a shift means for driving the stopper means; and a control means for controlling the shift means.

19 Claims, 13 Drawing Sheets

(1)

(2)

(a)

(b)

SHEET ACCUMULATION APPARATUS AND IMAGE FORMING SYSTEM HAVING SAME

BACKGROUND OF THE INVENTION

The present invention relates to a sheet accumulation apparatus for loading and storing sheets from a sheet outlet onto a tray means, the sheets being successively discharged from an image forming apparatus to the sheet outlet and an image forming system having the same, and relates to an improvement of the sheet accumulation apparatus enabling to regularly accumulate on the tray the mixed sheets of predetermined and standard sheets and nonstandard sheets such as tabbed sheets discharged from the sheet outlet.

FIELD OF THE INVENTION

In general, this kind of sheet accumulation apparatus has broadly been known as the apparatus for loading and storing the sheets discharged from the image forming apparatus such as a printing machine or a copying apparatus onto the tray means disposed under the sheet outlet. The apparatus of accumulating a large capacity of sheets continuously discharged vertically moves the tray means in response to the loading amount.

DESCRIPTION OF RELATED PRIOR ART

In such a sheet accumulation apparatus, for regularly accumulating the sheets discharged at high speed on the tray disposed under the sheet outlet, for example, Patent Document 1 (JP2003-341908) discloses an apparatus which nips the front ends of the sheets discharged from the sheet outlet, delivers them to the front end of the tray, releases from nipping at a predetermined position of the tray front end, drops on the tray and stores there. This document nips the fronts of the sheets from the sheet outlet with a gripper furnished to a belt, carries them to the front of the tray, causes a stopper disposed at the tray front to knock on the sheet front, releases from nipping, and drops the sheets on the tray. With this discharging mechanism, the sheets can be discharged on the tray at high speed, and at the same time, can be regularly stored there without breaking down the loading of the sheets.

[Patent document 1] JP2003-341908

With respect to the accumulation apparatus which carries the sheets from the sheet outlet on a carrier means as a belt onto the front of the tray at the sheet front ends, knocks on a stopper member with the front of the tray, and accumulates the sheets thereon, in case the lengths of the sheets in the sheet discharging direction from the sheet outlet are regularly fixed, the sheets can be comparatively uniformly loaded and held on the tray. But separating sheets such as center covers are sometimes attached, having tabs projecting outside than standard size sheets. Since the tabbed sheets are marked with titles or the like, those are formed in shape, for example, as shown in FIG. 4B, and the tabbed parts T project up and down as T1, T2, T3, T4 and T5. It is therefore preferable to discharge the tabbed sheets together with the standard size sheets from the sheet outlet and mix the tabbed sheets into the standard size sheets.

However, in case of discharging the tabbed sheets from the sheet outlet, for example, when forming the center covers by piling the tabbed sheets on the standard sheets having already been accumulated, the piling must be carried out such that the tabbed parts project from the end faces of the standard sheets. On the other hand, conventionally, when colliding the sheets against the stopper member at the sheet front ends in order to regularly store the sheets on the tray by separating (leaving) from the carrier means as the belt, since the stopper member is positioned in matching with the standardized size sheets having been in advance decided, if discharging the tabbed sheets, the tabbed parts projecting from the sheet front ends collide against the stopper member as they are, and are regulated in regard to the position and loaded on the tray.

Accordingly, there occurs a problem that the tabbed sheets are loaded as inclined on the tray, or not loaded in a correct posture as the center covers. Therefore, the prior art discharges the standard sheets from the image forming apparatus, piles to accumulate them on the tray. Apart from this, the prior art forms images by the image forming apparatus separately from the tabbed sheets used as the center covers, and thereafter inserts the tabbed sheets into the accumulated sheets on the tray.

Thus, a collating method of the prior art has disadvantages of being complicated in a finishing operation, or ready for causing binding errors such as deviations in page order, and at the same time, in case of mixing the tabbed sheets and the non-tabbed sheets and storing them on the tray, the sheets must be regularly aligned in reference to sheet stitching margins, otherwise a user must re-align the sheets discharged from the tray.

It is a main object of the invention to provide a sheet accumulation apparatus enabling to regularly accumulate the tabbed sheets into a chain of sheets when loading to hold the sheets from the sheet outlet onto the tray. It is another object of the invention to provide a sheet accumulation apparatus enabling to regularly accumulate on the tray the tabbed sheets together with the non-tabbed sheets in reference to the sides of the stitching margins.

It is further object of the invention to provide a sheet accumulation apparatus and an image forming system having the same, enabling to continuously discharge the sheets having images from the image forming apparatus and the tabbed sheets, and accumulate them on the tray in correct postures.

SUMMARY OF THE INVENTION

For attaining the above mentioned objects, the invention employs the following structures. In this invention, a term of "outer tab-end" designates such a portion (later mentioned XL position) meant by the side end of the tabbed sheet but not projecting the tab. There are furnished the sheet outlet for successively discharging the sheets having images with the stitching margin being rearward, the tray member disposed under the sheet outlet for loading to hold the sheets, a sheet carrier member disposed above the tray member for discharging the sheets from the sheet outlet to the side of a downstream, a sheet front end regulating member for colliding the sheets sent by the sheet carrier member against the regulating member at the sheet front ends and regulating them, and storing them on the tray member, and a sheet rear regulating member disposed to the tray member for regulating the positions of the sheets from the sheet outlet at the sheet rear ends.

The sheet front end regulating member comprises (1) stopper member movable back and forth in the sheet carrying direction; or (2) stopper members of two or more disposed back and forth in the sheet carrying direction and selectively facing the sheet front end regulating member; or (3) stopper member movable in a direction traversing with carrying along the sheet head ends; a shift member for driving the stopper member; and a control member for controlling the shift member. The control member has a tabbed sheet discriminating member for discriminating whether or not the sheet from the sheet outlet has a tab projecting from its front end, and the shift member is controlled in response to a discriminating result by the tabbed sheet discriminating member.

When the sheets from the sheet outlet are discriminated to be the tabbed sheets through the tabbed sheet discriminating member, the control member (1) moves the stopper members by a predetermined amount to the downstream side in the carrying direction, or (2) faces the stopper member among the above mentioned plurality of stopper members to the sheet regulating position, the stopper member being positioned at the downstream side in the carrying direction, or (3) moves the position of the stopper member in the direction traversing with carrying.

The plurality of stopper members are arranged in the sheet width direction, and the tabbed sheet discriminating member is constructed to enable to discriminate the tab positions in the sheet width direction. The shift member is constructed to (1) move the stopper member facing the tab position in the downstream side in the sheet carrying direction by the predetermined amount, or (2) face the stopper member disposed in the downstream side in the sheet carrying direction to the sheet regulating position, or (3) move the position of the stopper in the direction traversing with carrying. The control member actuates the shift member based on information from the tabbed sheet discriminating member.

The tabbed sheet discriminating member is constructed to acquire information of the tabbed sheets or the non-tabbed sheets from the image forming apparatus supplying the sheets to the sheet outlet and/or information of the tab position, and judges the tabbed sheets or the non-tabbed sheets, and/or the tab position by signals from a sensor disposed at an upstream side of the sheet outlet. The plurality of sensors are arranged in the direction traversing with carrying the sheets for detecting the tab-ends and the outer tab-ends.

The sheet carrier member is composed of a vacuum belt member holding the front ends of the sheets from the sheet outlet, or a grip belt member holding the front ends of the sheets. The sheet front regulating member is furnished above the tray member, and is composed of the stopper member for colliding the sheet heads thereagainst, the sheets being carried from the sheet carrier member.

The stopper member is movable in the sheet carrying direction along the sheet carrier member, while the control member controls the moving position of the stopper member in response to the length sizes of the sheets from the sheet outlet.

The image forming system comprises the image forming apparatus having the image forming member for forming images in succession on the sheets and a sheet supply member for supplying the sheets to the image forming member; a sheet discharging path, for guiding to the sheet outlet the sheets discharged from the image forming apparatus; and the sheet accumulation apparatus for loading to store the sheets from the sheet outlet. The sheet accumulation apparatus has any of the above mentioned structures. In this case, the sheet supply member has information of sorting the sheets as to whether or not the sheets to be supplied to the image forming member have the tabs projecting from the sheet fronts, and the tabbed sheet discriminating member of the sheet accumulation apparatus discriminates whether or not the sheets from the sheet outlet have the tabs on the basis of information of sorting the sheets.

EFFECTS OF THE INVENTION

For storing in mixture the tabbed sheets and non-tabbed sheets from the sheet outlet on the tray means, the invention stores in reference to the side of the sheet rear end such that the tabs position at the sheet front ends. The sheet front regulating means comprises (1) the stopper member movable back and forth in the sheet carrying direction; or (2) the stopper means of two or more disposed back and forth in the sheet carrying direction and selectively facing the sheet front regulating means; or (3) the stopper means movable in the direction traversing with carrying along the sheet front ends. Therefore, the invention displays the following effects. The sheets are loaded and stored on the tray in reference to the side of the stitching margin of the sheet rear ends under a condition that the tabs project toward the side of the sheet fronts.

Accordingly, it is possible to accumulate the sheets uniformly and in alignment by automatically discharging the tabbed sheets into the predetermined printed sheets from the image forming apparatus, not requiring the user to re-align the sheets taken out from the tray. Further, with respect to the construction thereof, it is sufficient to only move the stopper member back and forth in the sheet carrying direction or in the direction traversing with carrying, and the invention can offer the easy and cheap structure.

By discriminating the tab positions of the tabbed sheets and moving the stopper member facing the tab position back and forth in the sheet carrying direction or in the direction traversing with carrying, the sheets can be accumulated on the tray, not skewing the tabbed sheets.

DETAILED DESCRIPTION OF THE PREFERRED EMBODIMENTS

Figure 1:
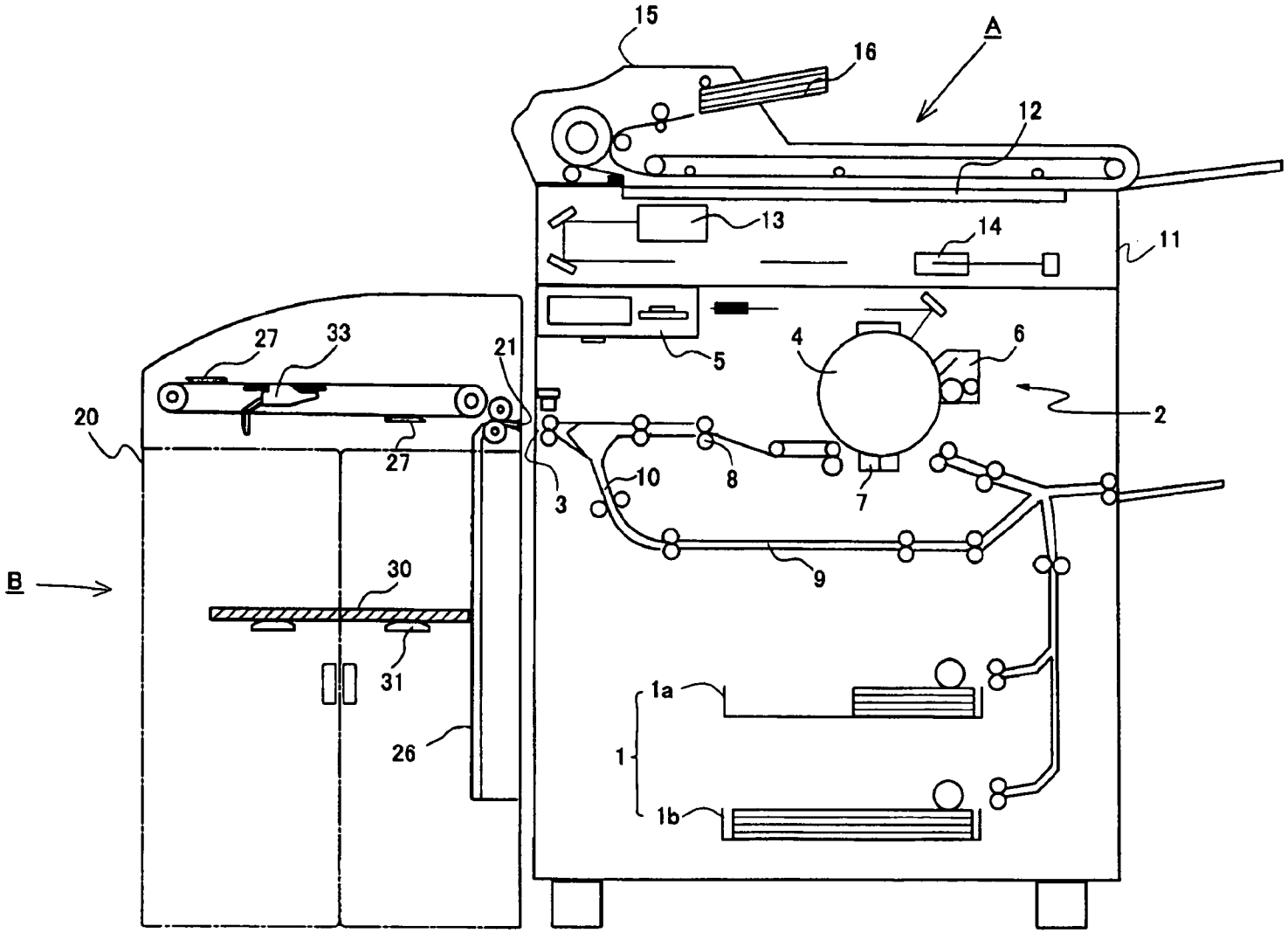
FIG. 1 is the whole view of the image forming system having the sheet accumulation apparatus according to the invention.
Figure 2:
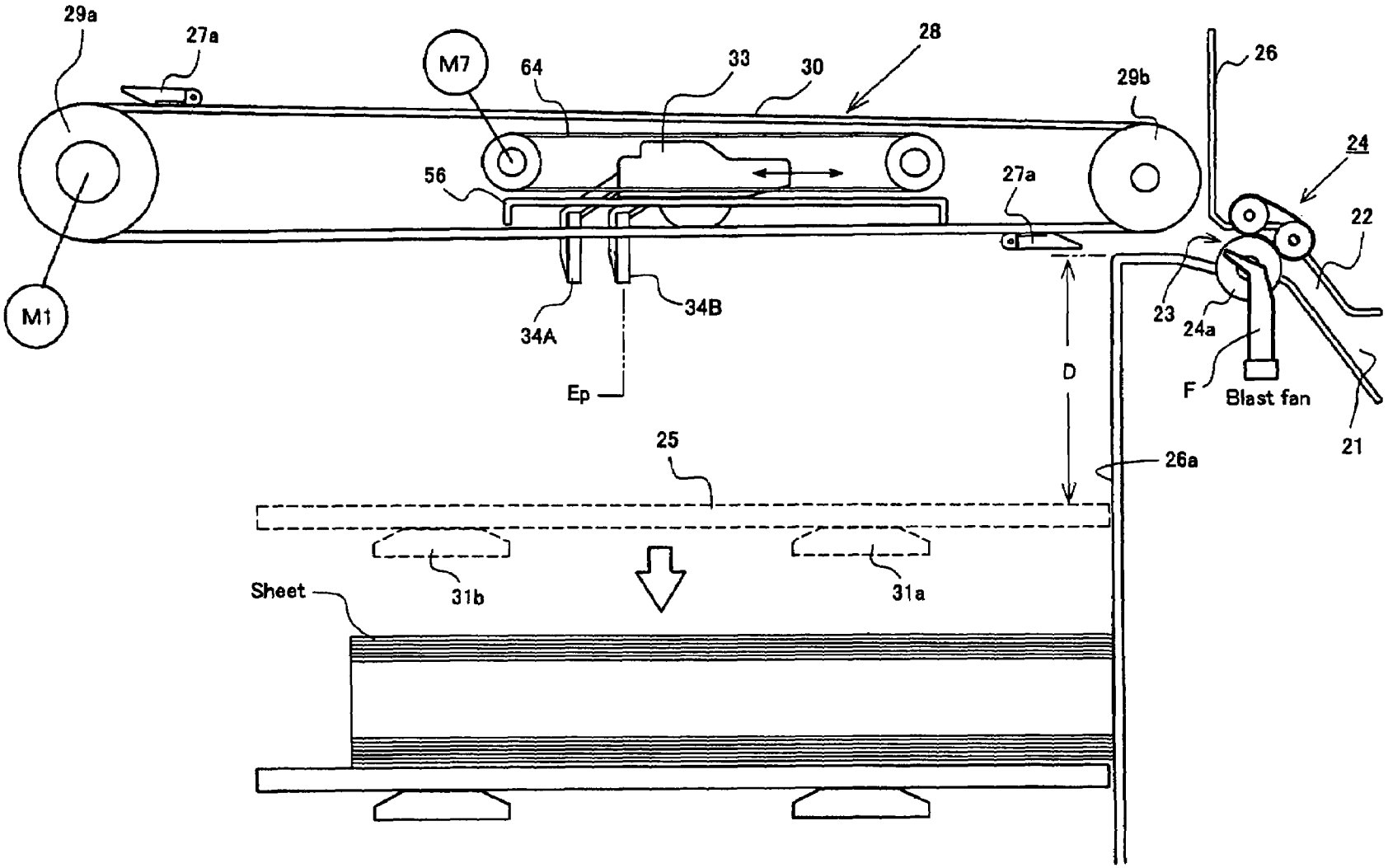
FIG. 2 is the elementarily structured view of the sheet accumulation apparatus.

In the following description, the invention will be explained in details based on the shown suitable embodiments. FIG. 1 is the whole view of the image forming system having the sheet accumulation apparatus according to the invention, and FIG. 2 is the elementarily structured view of the sheet accumulation apparatus.

[Image Forming System]

The image forming system shown in FIG. 1 is composed of the image forming apparatus A and the sheet accumulation apparatus B. The sheet accumulation apparatus B is connected to the sheet outlet 3 of the image forming apparatus A such that the sheets having images formed in the image forming apparatus A are loaded and stored on the tray of the sheet accumulation apparatus B. Explanation will be made in order of the image forming apparatus A and the sheet accumulation apparatus B.

[Image Forming Apparatus]

At the outset, one example of the image forming apparatus for forming images on the sheets is shown in FIG. 1, and explanation will be made thereto. The image forming apparatus A as shown in FIG. 1 sends the sheets from the sheet supply part 1 to the image forming means 2, prints on the sheet by the image forming means 2, and then discharges them from the sheet outlet 3. The sheet supply part 1 stores various sizes of the sheets in sheet supply cassettes 1*a*, 1*b*, separates the designated sheets one by one, and supplies to the image forming means 2. The image forming means 2 has, e.g., an electrostatic drum 4, an printing head 5 (laser luminous organ) arranged therearound, a development unit 6, a transcription charger 7, and a fixing unit 8. Electrostatic latent images are formed on the electrostatic drum 4 by the laser luminous organ 5, adhered with toners by the development unit 6, transcribed with the images on the sheet by the transcription charger 7, and heat-fixed with the fixing unit 8. The sheets formed with images in the above manners are discharged in succession from the sheet outlet 3 (called as "sheet outlet of the main body" hereafter). A numeral 9 designates a circulation path for printing both surfaces of the sheets, which turns reversely the sheet printed on an upper surface from the fixing unit 8, again sends to the image forming means 2. The sheets printed on both surfaces are turned reversely and discharged from the sheet outlet 3.

A numeral 11 designates an image read apparatus, which scans an original document sheet set on a platen 12 by means of a scan unit 13, and electrically reads with a photoelectric conversion element (not shown). This image data is subjected to, e.g., a digital process by an image processing part, then transferred to a data memory 14 in order to send an image signal to the laser luminous organ 5. Further, a numeral 15 designates an original document sending apparatus which is a feeder apparatus for sending the original document sheet held in an original document stacker 16 to the platen 12.

[Sheet Accumulation Apparatus]

Next, the sheet accumulation apparatus B will be referred to. The shown sheet accumulation apparatus B is composed of a sheet bringing-in path 21, tray means 25, sheet carrier means 28 and sheet front regulating means 33, which are disposed within a suitably shaped housing 20 (see FIG. 1). The sheets are sent from the sheet bringing-in path 21 to the sheet outlet 23, carried to the side of the tray front by the sheet carrier means 28, collided against the sheet front regulating means 33, separated from the carrier means, and dropped on the tray means 25 for storage.

[Sheet Bringing-in Path]

The sheet bringing-in path 21 comprises a carrier guide having a sheet inlet 22 and the sheet outlet 23, and has a sheet discharge means 24 for discharging the sheets. The sheet discharge means 24 is, as shown in FIG. 2, composed of a drive roller 24*a* and a follower belt 24*b* (also enough with a follower roller), and discharges the sheets from the sheet inlet 22 to the sheet outlet 23. Further, this path 21 is arranged with a blast means F having an air jetting outlet (not shown) for cooling the sheets on carriage and at the same time, guiding the sheets from the sheet outlet to a later mentioned sheet carrier means 28 by an air flow. Shown S1 designates sheet discharge sensors for detecting the sheet heads and the sheet rear ends.

[Sheet Carrier Means]

The sheet outlet 23 is equipped with the sheet carrier means 28 at the upper part of the downstream side. The sheet carrier means 28 comprises a grip belt for nipping the sheets or a vacuum belt, nips or absorbs the sheets from the sheet outlet 23, and carries to the tray front side. Because, if directly discharging the sheets from the sheet outlet 23 on the tray, these sheets contact the sheets on the tray and invite badness during discharging the sheets (jamming), and the sheet discharging speed is limited owing to frictional resistance, and accordingly, because the sheets are moved to the tray front at the same speed as the speed of discharging the sheets by the sheet discharging means from the sheet outlet 23 by the sheet carrier means, and the sheets are dropped and loaded under a condition that the whole of the sheets move onto the tray. Therefore, the sheet carrier means 28 is composed of the vacuum belt absorbing the sheets or the grip belt nipping the sheet heads.

The structure of the latter grip belt will be explained. Above a later mentioned tray means 25, a pair of pulleys 29*a*, 29*b* are furnished with respect to an apparatus frame 26, and between the pulleys, a sending belt 30 is expanded. The sending belt 30 is provided with a gripper member 27. The gripper member 27 has nip pieces 27*a* engaging the sheet fronts for holding the fronts of the sheets from the sheet outlet 23 and guiding them to a predetermined exhausting position Ep (see FIG. 2), and is furnished integrally to the sending belt 30 in order to move at the same speed as that of the sheets from the sheet outlet 23. The pulley 29*a* of the sending belt 30 is so connected to a drive motor M1 as to rotate in the clockwise direction in FIG. 2. Therefore, if stopping the sending belt 30 and discharging the sheets from the sheet outlet 23 under the condition of facing the gripper member 27 to the sheet outlet 23, the sheet fronts go forward between the nip piece 27*a* and the belt surface, and are held owing to elastic force of the nip piece 27*a*. By the way, the shown "Sp1" designates a sensor of detecting a level of the sheet surface, and will be mentioned as to an operation later.

[Sheet Front Regulating Means (Stopper Unit)]

Figure 3:
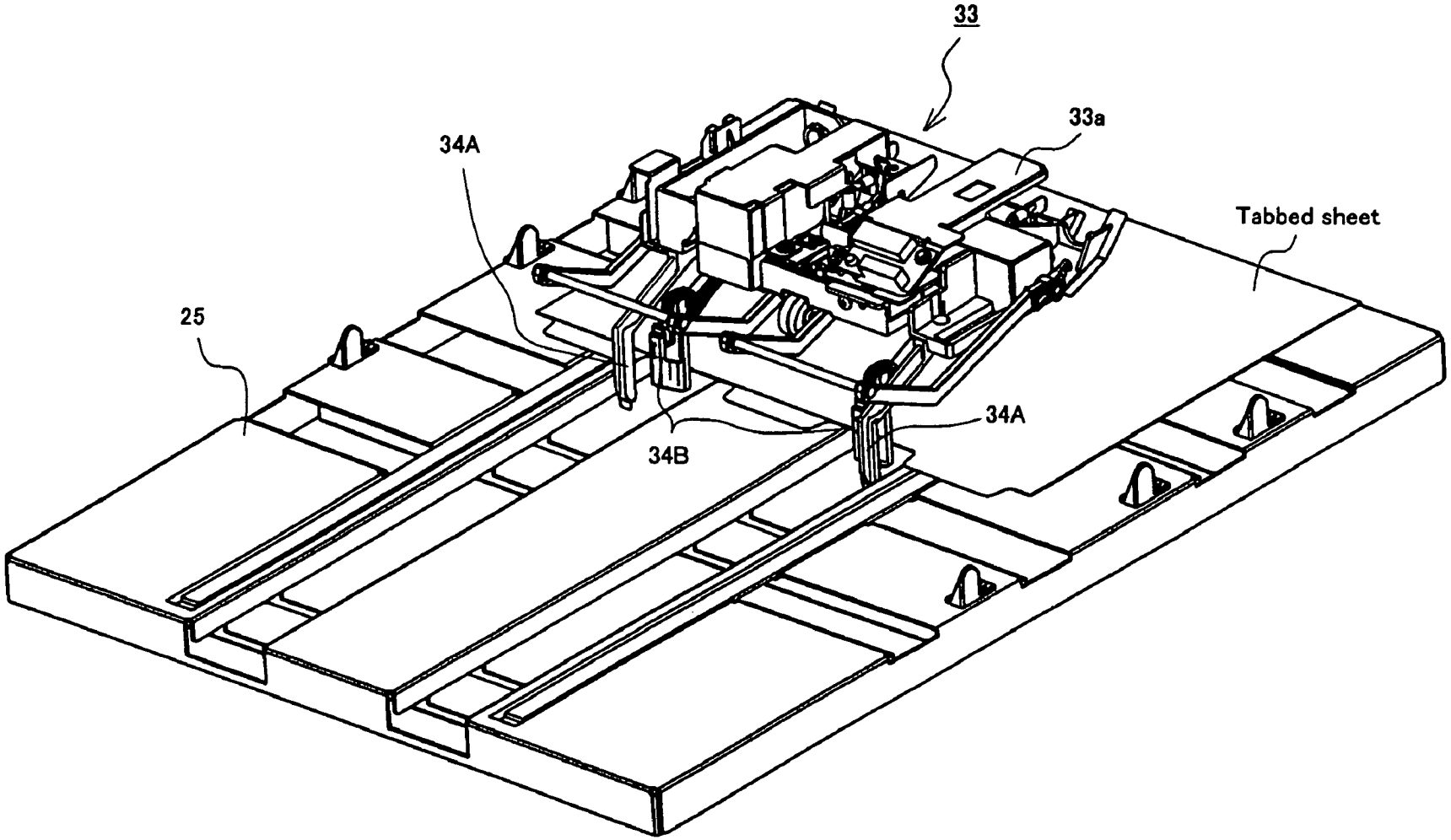
FIG. 3 is the whole perspective view of the sheet front regulating means of the apparatus in FIG. 2.

The discharging position Ep of the sheet carrier means 28 is provided with a sheet front regulating means 33. The sheet front regulating means 33 is, as shown in FIGS. 2 and 3, arranged in parallel with the sending belt 30 above the tray means 25, and has the stopper member 34 which collides with the fronts of the sheets moved by the sending belt 30 and separates from the sheet carrier means 28. The shown stopper member 34 is disposed in a stopper unit 33 (the sheet front regulating means) which is composed by mounting the stopper member 34 on a base frame 33*a* supported by the apparatus frame 26 movably in the carrying direction. A reason why the stopper member 34 is composed movably in the sheet carrying direction is because the carrying positions Ep are different in dependence on the length sizes of the sheets. Therefore, the base, frame 33*a* is guided by a guide rail 56 furnished with respect to the apparatus frame 26, and is supported movably in the carrying direction. The base frame 33*a* is secured to a moving belt 64 having a moving motor M7, and is composed movably back and forth in the sheet carrying direction by reciprocal rotation of a unit moving motor M7.

Figure 4A:
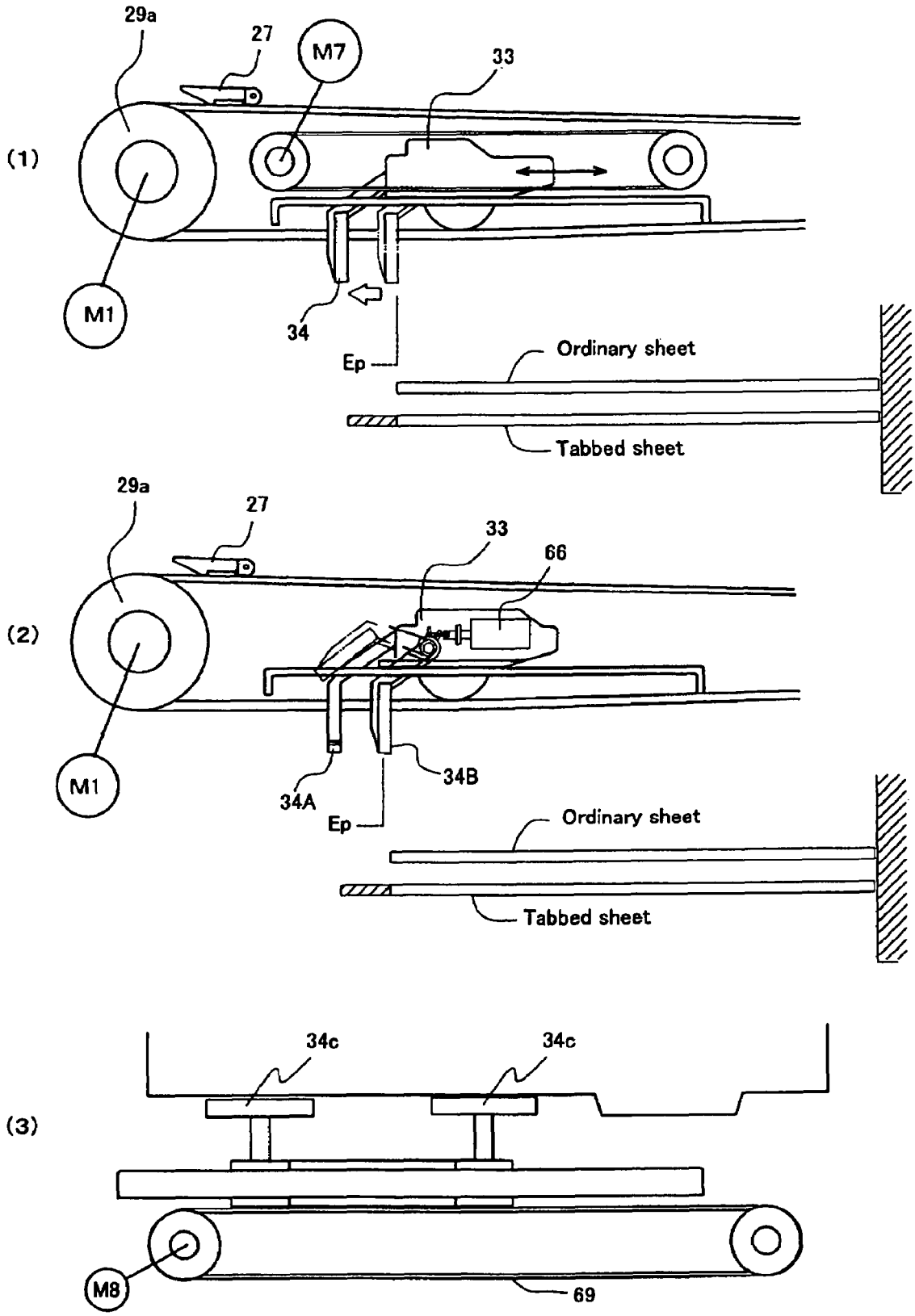
FIG. 4A shows the structure of the stopper member of the sheet front regulating means, where (1) is the first embodiment, (2) is the second embodiment, and (3) is the third embodiment.
Figure 4B:
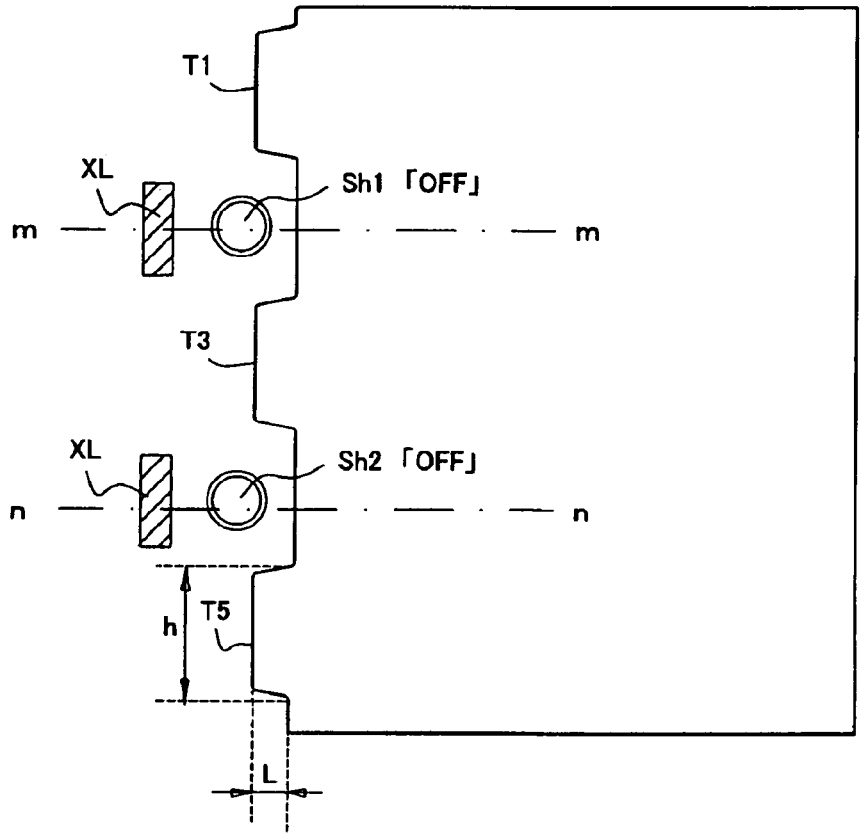
FIG. 4B shows the detecting methods, where (1) and (2) are the tabbed sheet discriminating means.
Figure 4B:
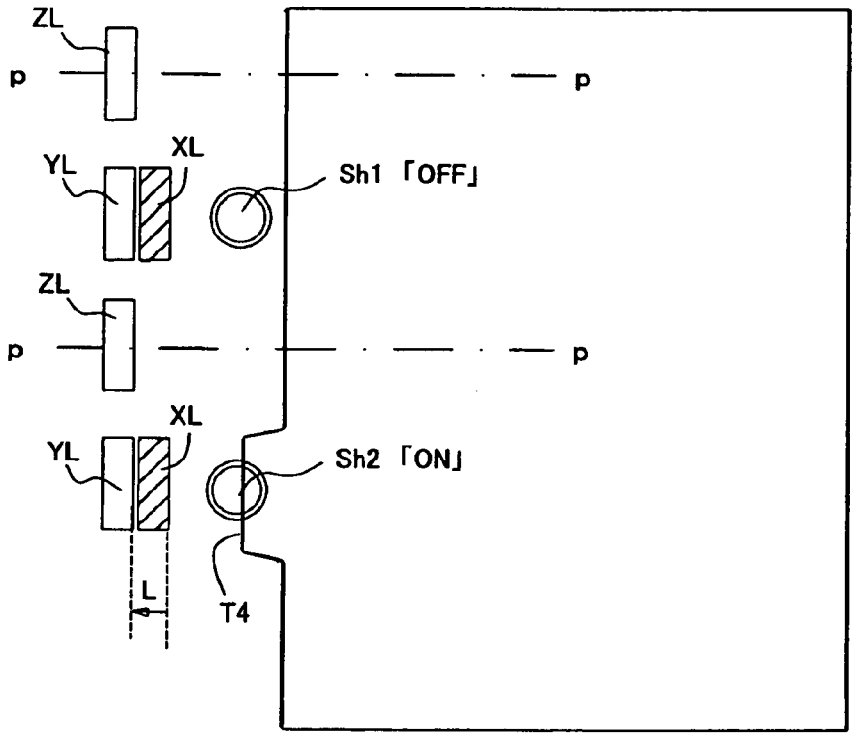

With the above mentioned construction, the sheets from the sheet outlet can be dropped and accumulated on a later mentioned tray means 25 by moving the position of the stopper member 34 in response to the length sizes. The tray means 25 is provided with a sheet rear end regulating means 26*a* for positionally regulating the sheet rear ends, and the sheets are accumulated and stored in reference to the sheet rear end regulating means 26*a*. Therefore, the invention is based on the premise that when mixing the tabbed sheets as shown in FIG. 4B with the non-tabbed sheets (called as "ordinary sheets" hereafter) and accumulating on the tray, the sheets are sent to the sheet outlet 23 with the stitching margins being at the rear ends, and aligned along the sheet rear end regulating means 26*a* on the tray means 25 in order to project the tab position from the sheet front head. Therefore, the invention is characterized in that, with respect to the base frame 33*a*, any of the stopper members 34 facing the sheets to the discharging position Ep is (1) structured (1st embodiment) movably back and forth in the sheet carrying direction, or (2) structured (2nd embodiment) with the stopper means of two or more disposed back and forth in the sheet carrying direction and selectively facing the sheet front regulating means, or (3) structured (3rd embodiment) movably in the direction traversing with carrying along the sheet front ends, and that the shift means is provided.

1st Embodiment

In the above mentioned structure, the stopper member 34 suspending to the side of the sending belt 30 is mounted on the base frame 33*a*. There is provided one stopper member 34 in the sheet width direction or a plurality thereof with spaces. By driving the unit moving motor M7, the position in the carrying direction of the stopper member 34 is offset. The offsetting amount is met with the tab width L of the tabbed sheets. In short, the ordinary sheets cause the stopper member 34 to face the predetermined discharging position Ep, while in case of the tabbed sheets, the stopper unit 33 is moved to the downstream side in the carrying direction by the tab width L. Thereby, the tabbed sheets are offset-accumulated on the tray by the amount corresponding to the tab width. In this case, the unit moving motor M7 makes the shift means, and the control circuit of the unit moving motor M7 makes the control means 70.

Accordingly, when the tabbed sheets are discharged by a signal from a later mentioned tabbed sheet discriminating means 71, the control means 70 moves the stopper unit 33 to the downstream side by the tab width L in the carrying direction. With respect to the moving amount, the unit moving motor M7 is composed of, for example, a stepping motor, rotates and drives the stepping number corresponding to the tab width L. In the above mentioned case of the tabbed sheets, there is a case of colliding to regulate the sheets at the predetermined discharging position Ep, not moving the stopper member 34 to the downstream side in the carrying direction, and this regard will be mentioned later.

2nd Embodiment

In case of moving the stopper unit 33 each time when carrying the tabbed sheets as mentioned above, there occurs a problem involved with the moving speed (responsibility). In such a case, it is sufficient to employ the following structure. Similarly to the above mentioned, the stopper unit 33 is made movable in the sheet carrying direction by the unit moving motor M7. On the base frame 33*a* of the stopper unit 33, there are mounted the stationary stopper 34A suspending to the side of the moving belt 30 and the movable stopper 34B. The stationary stopper 34A is composed of plural stopper pieces taking the distances in the sheet width direction, and each of them is secured to the base frame 33*a*. The movable stopper 34B is also composed of plural stopper pieces in the sheet width direction, and is axially supported movably between the operating position (the solid line in FIG. 4A(2)) hanging to the side of the moving belt 30 and the retreating position (the chain line in FIG. 4A(2)) retreating upward, and is connected to an operating solenoid 66. The movable stopper 34B is arranged backward by the distance L (the tab width) with respect to the stationary stopper 34A. Accordingly, a case that the sheets sent on the moving belt 30 collide against the stationary stopper 34A and are stored on the tray and another case that the sheets collide against the movable stopper 34B and are stored on the tray, are offset by the distance L (the tab width).

The plurality of stopper members 34A and 34B disposed taking the spaces back and forth in the sheet carrying direction are selectively suspended to the side of the moving belt 30 so as to control an actuation solenoid 66 (the shift means), whereby it is selected to collide the sheets against the movable stopper 34B, otherwise, against the stationary stopper 34A. Therefore, when the tabbed sheets are discharged by a signal from a later mentioned tabbed sheets discriminating means 71, the control means 70 composed of the control circuit of the actuation solenoid 66 moves the movable stopper 34B to the retreating position for colliding the sheets against the stationary stopper 34A to regulate them. Further, when the ordinary sheets are discharged, the movable stopper 34B is moved to the actuating position for colliding the sheets against the movable stopper 34B to regulate them. Thereby, the tabbed sheets are regulated by the stationary stopper 34A at the downstream side in the sheet carrying direction, while the ordinary sheets are regulated by the movable stopper 34B at the upstream side, and the tabbed sheets are accumulated on the tray under the condition that the tabs project from the sheet head ends. In the above mentioned case of the tabbed sheets, there is a case of colliding the sheets against the movable stopper 34B in response to the tab position to regulate them, and this regard will be mentioned later.

3rd Embodiment

Similarly to the above mentioned, the stopper unit 33 is made movable in the sheet carrying direction by the unit moving motor M7. To the base frame 33*a* of the stopper unit 33, the stopper member 34 suspending to the side of the moving belt 30 is arranged movably in the sheet width direction. The shown stopper member is composed of back and forth two stopper pieces 34C being wider than length ("h" in FIG. 4B) of the tab. The stopper pieces 34C are secured to the timing belt 69 moving in the sheet width direction and connected to a width moving motor M8. Accordingly, the width moving motor M8 composes the shift means, and the control circuit of the width moving motor M8 composes the control means 70.

The control means 70 discriminates whether the sheets are the tabbed sheets or the ordinary sheets by the signal from a later mentioned tabbed sheet discriminating means, and concurrently judges the tab position. Judging of the tab position will be later mentioned, and in the case of the tabbed sheets, the width moving motor M8 rotates in response to the tab position and moves the stopper piece 34C to a ZL position being a part (the outer tab-end) other than the tab position of the sheet head ends. Thereby, with the stopper piece 34C of one position (for example, one pair of left and right in the width direction), both of the ordinary sheets and the tabbed sheets collide at the predetermined discharging position Ep, regulate them and accumulate to store on the tray 25. Then, the sheets are accumulated under the condition that the tab position projects outward from the sheet head ends. If making the structure by moving the stopper piece 34C in the sheet width direction so that the tab position (the tab projection) and the stopper pieces do not interfere, the tab projection is never bent by the stopper pieces.

Next, explanation will be made to "the tabbed sheet discriminating means 71" in the above mentioned 1st to 3rd embodiments. For the tabbed sheet discriminating means 71, for example, two sheet sensors Sh are furnished in the sheet bringing-in path 21. FIG. 4B shows them, and the 1st sensor Sh1 and the 2nd sensor Sh2 are furnished at the shown positions for detecting the sheet front ends. FIG. 4B shows that the sheets of A4 size of JIS are discharged in the transverse attitudes, and this case gives the tabs to the five positions of T1, T2, T3, T4, T5. As shown in FIG. 4B(1), in the sheets of tab T1, tab T3, tab T5, both of the 1st sensor Sh1 and the 2nd sensor Sh2 are OFF, and on the other hand, in the sheets of tab T2, and tab T4 shown in the same (2), any one of the 1st sensor Sh1 and the 2nd sensor Sh2 is OFF and the other is ON (the illustration shows the case of the 1st sensor Sh1 being "OFF" and the 2nd sensor Sh2 being "ON"). In the former of (tabs T1, T3, T5), it is sufficient to collide the sheets at the XL position, while in the latter of (tabs T2, T4), it is sufficient to collide the sheets at the ZL position. The tabbed sheet discriminating means 71 also may get information of the tabbed sheets or not from the image forming apparatus A, and of the tab position concurrently. In this case, it is also sufficient to memorize what sheets are previously set, for example, in the above mentioned sheet supply cassettes 1*a*, 1*b*, and transfer, to the sheet accumulation apparatus B, information as to whether or not the sheets are the tabbed sheets and as to which position the tabs are present, by means of which cassette the sheets are supplied from by a signal designating the sheet supply.

The control means 70 bases on the judging results of the tabbed sheet discriminating means 71 and controls the stopper member 34 as follows. (1) In the 1st embodiment, the stopper member 34 positions the stopper piece 34 in m-m and n-n of FIG. 4B, and when the tab position of the tabbed sheets is at T1 or T3 or T5, this is judged from the 1st sensor Sh1 and the 2nd sensor Sh2 (=all OFF), and the sheets collide against the stopper member 34 positioning at the predetermined discharging position Ep, and are regulated. In short, both of the ordinary sheets and the tabbed sheets collide against the stopper member 34 placed at the same discharging position Ep, and are regulated. When the tabbed sheets position at T2 or T4, this is judged from the 1st sensor Sh1 and the 2nd sensor Sh2 (=any one is ON and the other is OFF), and the stopper member 34 is moved at the downstream side in the sheet carrying direction by the distance L (tab width) from the discharging position Ep. Thereby, the tabbed sheets of the tab T2 and T4 are accumulated on the tray 25 under the condition that the tab project.

Next, (2) in the 2nd embodiment, the movable stopper 34B and the stationary stopper 34A adjacently position in m-m and n-n of FIG. 4B, and when the tab position of the tabbed sheets is at T1 or T3 or T5, this is judged from the 1st sensor Sh1 and the 2nd sensor Sh2 (=all OFF), and the sheets collide against the movable stopper 34B positioning at the predetermined discharging position Ep, and are regulated. In short, both of the ordinary sheets and the tabbed sheets collide against the movable stopper 34B placed at the same discharging position Ep, and are regulated. When the tabbed sheets position at T2 or T4, this is judged from the 1st sensor Sh1 and the 2nd sensor Sh2 (=any one is ON and the other is OFF), and the sheets collide against the stationary stopper 34A offset positioning by the distance L (tab width) from the movable stopper 34B. Therefore, the control means 70 moves the movable stopper 34B to the retreating position. Thus, by selecting the positioning relation between the tab position and the stopper member 34, the tabbed sheets can be accurately accumulated on the tray.

(3) In a case of the 3rd embodiment, the stopper piece 34C is positioned in the width direction of m-m and n-n of FIG. 4B, and when the tab position of the tabbed sheets is at T1 or T3 or T5, this is judged from the 1st sensor Sh1 and the 2nd sensor Sh2 (=all OFF), and the sheets collide against the stopper piece 34C at the predetermined position and are regulated. In short, both of the ordinary sheets and the tabbed sheets collide against the stopper piece 34C at the position in the same width direction, and are regulated. When the tabbed sheets position at T2 or T4, this is judged from the 1st sensor Sh1 and the 2nd sensor Sh2 (=any one is ON and the other is OFF), and the width moving motor M8 is rotated to move the stopper piece 34C to a p-p position of FIG. 4B(2), and the sheets collide against the stopper piece 34C, and are regulated. By moving the position in the width direction of the stopper piece 34C by the tab position, the tabbed sheets can be accurately accumulated on the tray 25.

[Sheet Side Aligning Means]

As mentioned above, the sheets from the sheet outlet 23 are carried on the sheet carrier means 28 to the tray front side, stripped from the sheet carrier means 28 by the sheet front regulating means 33, and are dropped on the tray 25. In this course, the sheets are corrected at the attitude in the direction traversing with carrying by the sheet side aligning means 54, aligned and stored on the tray. Therefore, the sheet side aligning means 54 composed of the aligning members 54*a*, 54*b* is furnished for the sheet side ends (back and forth in FIG. 2) carried by the sheet carrier means 28. With respect to the construction, as shown in FIG. 2, a rear side aligning member 54*b* at the rear side of the apparatus and a front side aligning member 54*a* suspend from the upper side to the down side. Both aligning members 54*a*, 54*b* (generically called as "aligning member 54" hereafter) are supported by an axial member 54*c* as shown in FIG. 5A, and move laterally.

The shown aligning members 54 are fittingly supposed on the axial member 54*c* movably with respect to an engaging position X (see FIG. 5A) engaging the sheet side ends, awaiting position Y somewhat separating from the sheet side ends, and a retreating position Z enough separating from the sheet side ends. The aligning members 54 are connected to a lateral pair of shift levers 56 communicating with a width-end registering motor M4, and both levers are in mesh with pinions M4*p* of the motor M4. Accordingly, the aligning members 54 move positionally by rotation of the pinion M4*p* in response to the sheet width sizes. In short, the aligning members 54 of the rear side and the front side move to positions agreeing with the sheet width sizes by rotation of the width-end registering motor M4, and reciprocally move on these positions by the reciprocating rotation of the pinion M4*p* between the waiting position Y somewhat separating from the sheet side end and the engaging position X (operating position) engaging the sheet side ends. Further, the aligning members 54 move to the retreating position Z enough separating from the sheet side end by the width-end registering motor M4.

Figure 5A:
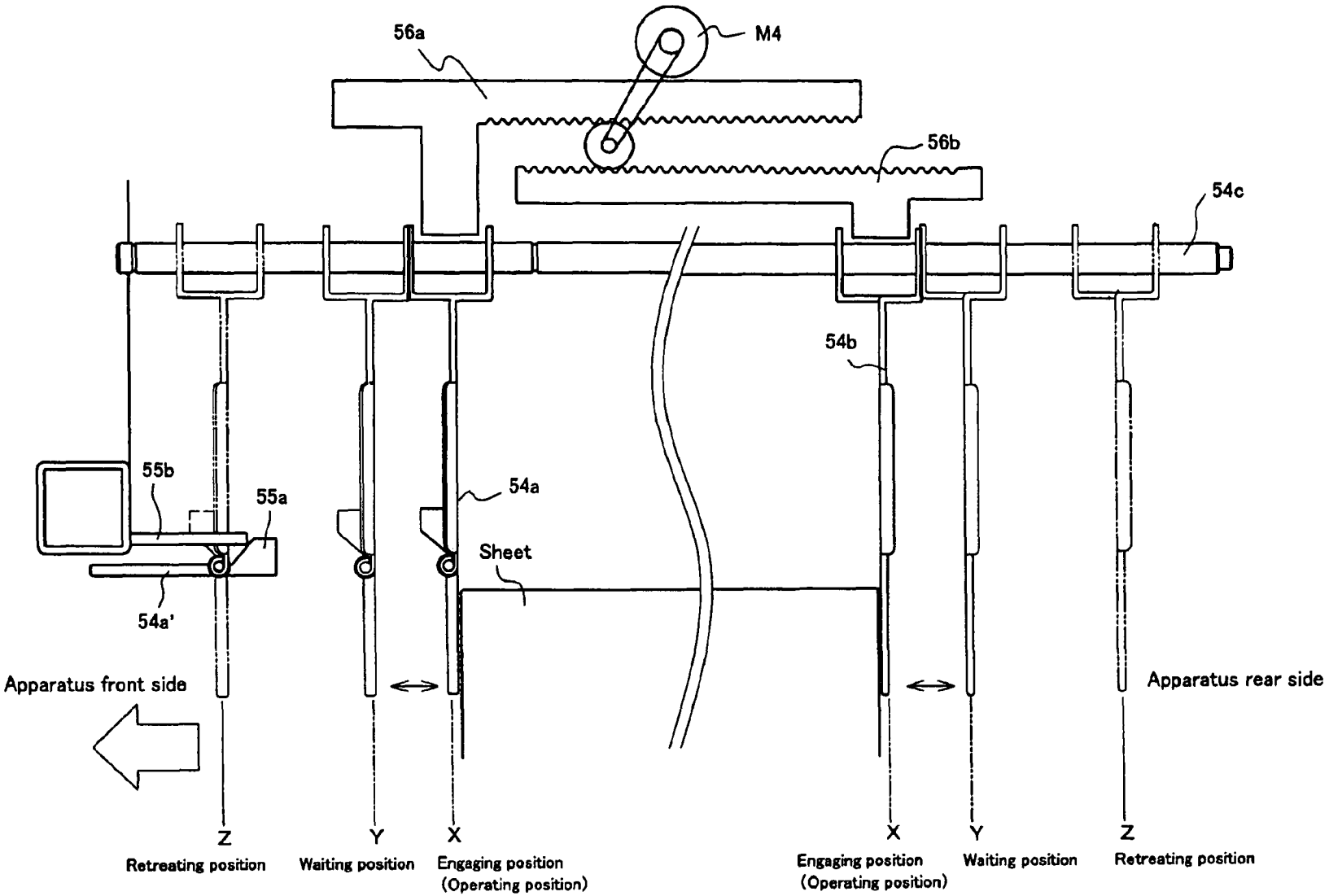
FIG. 5A is the view explaining operations of the sheet side aligning means.

At the same time with the motor M rotating to the retreating position Z, the aligning member 54*a* of the front side causes a front end suspending piece 54*a*' suspending to the side of the tray 25 to bend at the retreating position Z as shown in FIG. 5A. As to the structure thereof, the front end suspending piece 54*a*' is pivoted rotatably at the base portion, and is urged by a spring (not shown) under conditions shown with solid lines in the engaging position X (operating position) and the waiting position Y in FIG. 3. The front end suspending piece 54*a*' has a cam piece 55*a* with which a projecting lever 55*b* formed in the apparatus frame 26 contacts. Accordingly, when the front end suspending piece 54*a*' of the aligning member 54*a* of the front side moves from the waiting position Y to the retreating position Z, the cam piece 55*a* contacts with the projection lever 55*b* of the apparatus frame 26 and bends as shown with the solid line. With respect to the retreating position Z of the pair of aligning members 54, the aligning member 55*a* retreats and rocks above the tray, which (aligning member 55*a*) separates from the sheet side ends in the direction traversing with sheet carrying and positions at the side of taking out at least the sheets on the tray means. Therefore, when taking out the tray 25 together with the sheets accumulated in an arrow direction (the side of the apparatus frame), the aligning member 54*a* of the front side retreats above the tray.

Figure 5B:
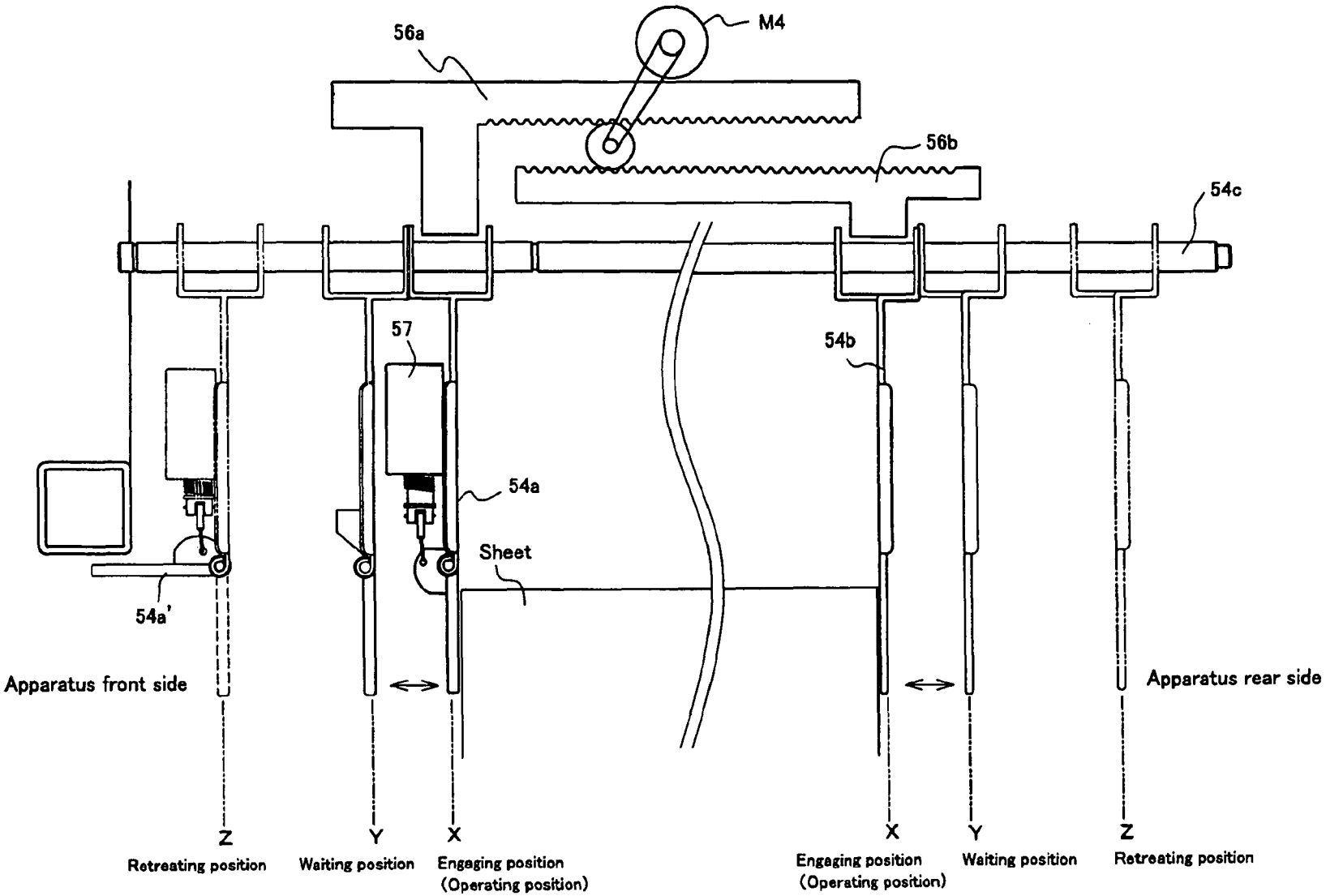
FIG. 5B is the embodiment different from that of FIG. 5A.

The above mentioned aligning member 54*a* of the front side may have a structure as shown in FIG. 5B. The front end suspending piece 54*a*' pivoted to the aligning member 54*a* is connected to an electromagnetic solenoid 57, and can move to the retreating position shown with the solid line shown in the same by pulling the front end suspending piece 54*a*' against an urging spring by means of the solenoid. The electromagnetic solenoid 57 is operated by a signal designating, e.g., a later mentioned tray elevating arm 31 to go down to an attaching and detaching position (a lowermost position).

Next, the above mentioned width-end registering motor M4 will be explained as to controlling. This motor M4 has a structure of a driving means for moving the aligning member 54 between the engaging position X (operating position) and the retreating position Z. The driving means has a structure of moving the sheet side aligning means from the engaging position to the retreating position by any of signals (which will be later mentioned) of (1) the control signal of moving down the tray elevating means 31, or of (2) a detecting sensor S3 of the carrier means 41 set at the tray attaching and detaching position, or of (3) a detecting sensor (a later mentioned door opening and closing sensor. S5) of detecting an opening operation of an opening and closing doors 50*a*, 50*b* for positioning the carrier means 41 at the tray of attaching and detaching position.

[Sheet Rear End Pushing Down Means]

Figure 6:
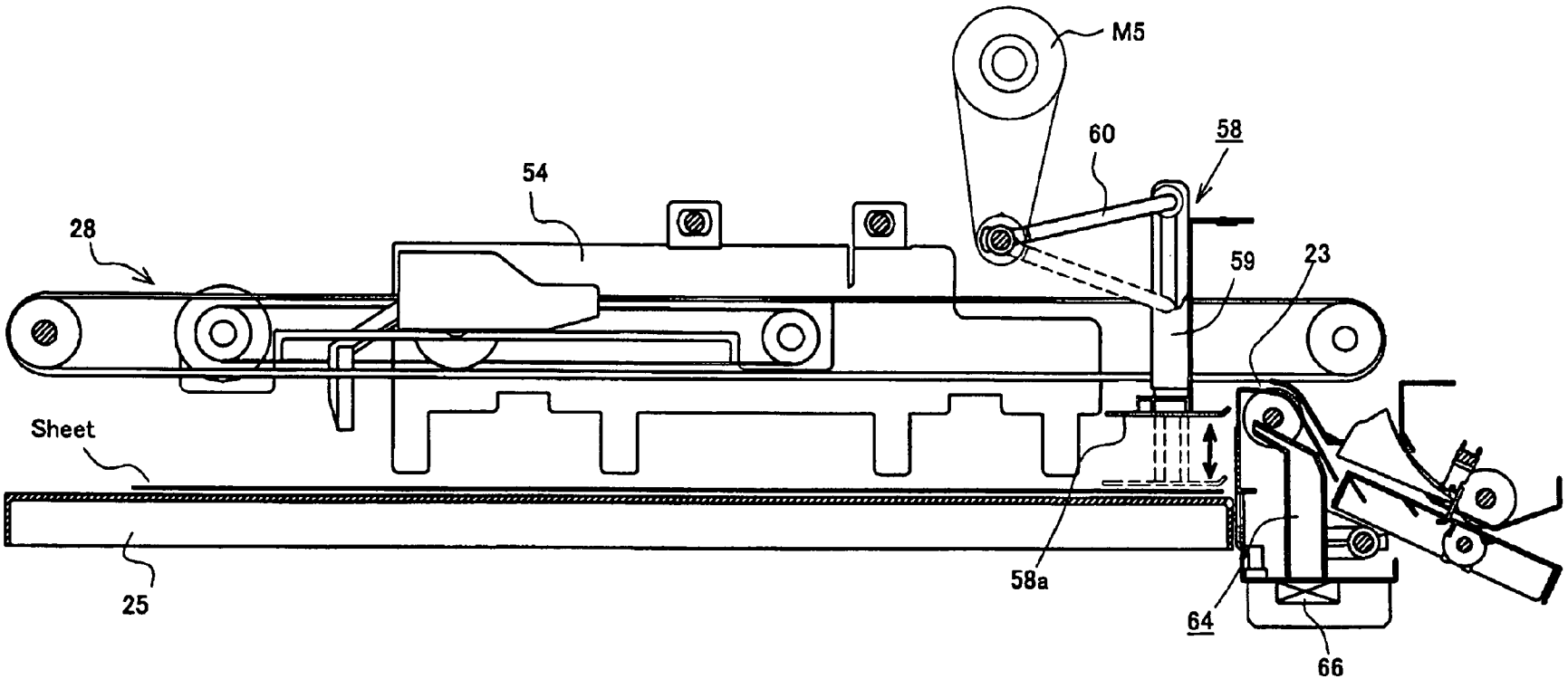
FIG. 6 is the view explaining operations of the sheet back end pushing-down means.

In the course of the sheets dropping to the tray means 25 together with the above mentioned sheet side aligning means 54, there is furnished a sheet rear end pushing down means 58 for beating the sheet rear ends toward the tray side. The sheet rear end pushing down means 58 is, as shown in FIG. 6, disposed above the downstream side of the sheet outlet 23, and has a beating piece 58*a* for beating the rear ends of the sheets from the sheet outlet 23 toward the lower tray means 25. The beating piece 58*a* passes through a supporting cylinder 59 secured to the apparatus frame 26, and connect with the driving lever 60 communicating with the driving motor M5. By reciprocal rotation of this motor M5, a driving lever 60 turns at a predetermined angle, and the beating piece 58*a* connecting thereto moves vertically between the solid line and the chain line of FIG. 6. Therefore, the sheets are stripped from the sheet carrier means 28 by the sheet front end regulating means 33, and are beaten down at the rear ends and stored onto the tray 25.

[Structure of the Tray Means]

The tray means 25 is structured with a sheet accumulating bed (called as "tray 25" hereafter) for accumulating the sheets, substantially horizontal, and is capable of loading maximum size sheets. The shown tray 25 has a structure made of the tray members separating from the apparatus frame 26 for enabling to convey the sheets shaped especially in pallet outside of the apparatus.

[Tray Elevating Means]

Figure 7:
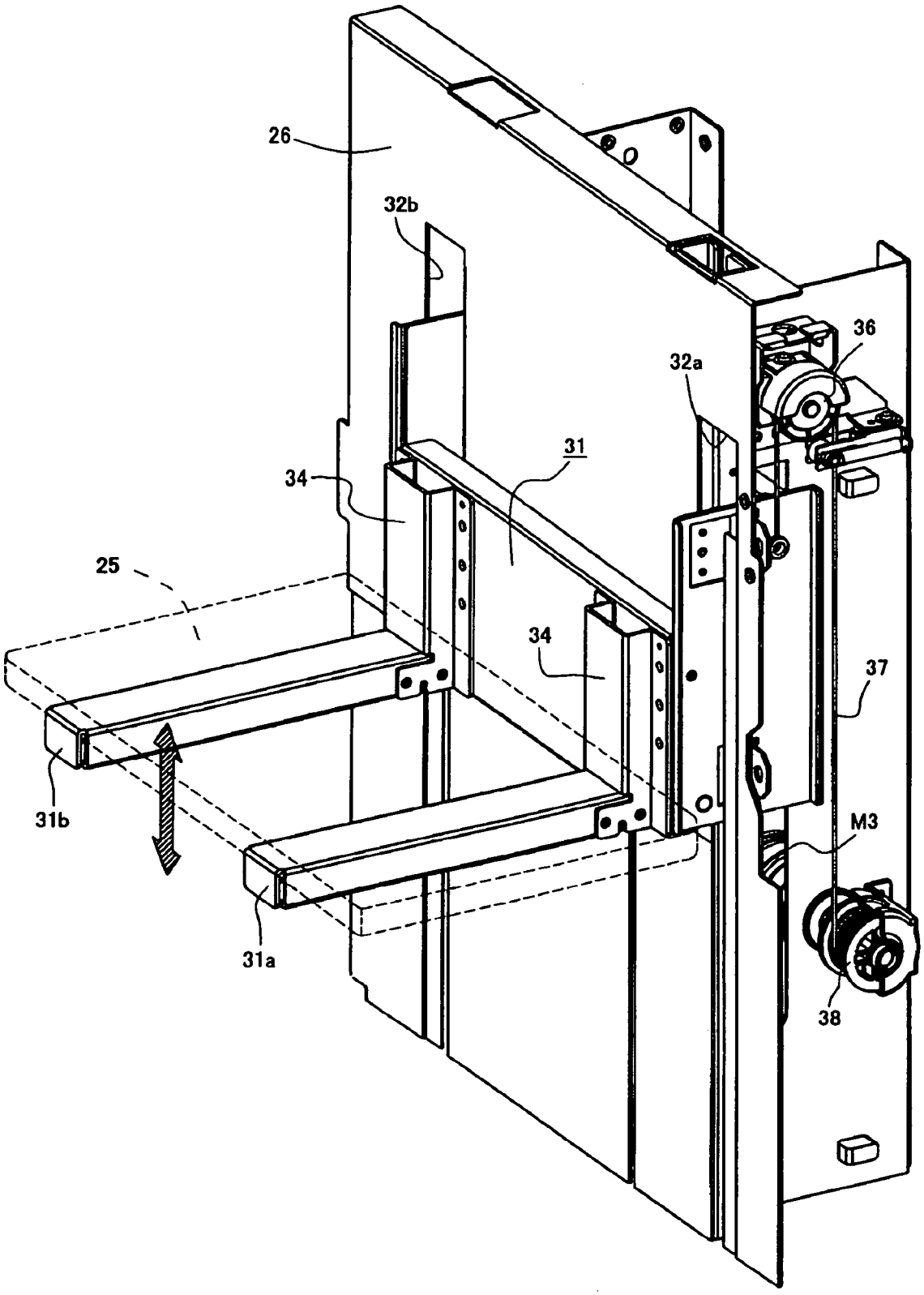
FIG. 7 is the view explaining the structure of the tray elevating means and the tray means.

The tray elevating means 31 attaching the above mentioned tray means 25 is, as shown in FIG. 7, structured with fork shaped elevating arms 31*a*, 31*b* (fork members, the same in the following) vertically movably attaching to the apparatus frame 26. Regarding to the elevating arm 31, guide rails 32*a*, 32*b* are provided to the apparatus frame 26, guided in the accumulating direction (in the vertical direction in FIG. 7) along these rails and are vertically movably supported. The elevating arm 31 is wound with a pulling member 37 such as a wire or a belt wound on a winding pulley 36 secured to the apparatus frame 26, and the shown pulling wire connects with a coiling pulley 38 with which the elevating motor M3 connects. The elevating arm 31 is supported by the guide rail 32 of the apparatus frame 26, so that it moves vertically by the elevating motor M3. The tray 25 is mounted on the elevating arms 31*a*, 31*b*, and move up and down in response to the accumulating amount under the sheet outlet 23. The elevating arms 31*a*, 31*b* are equipped with the sheet rear end regulating member 26*a*, and the sheets from the sheet outlet 23 collide at the rear ends against the sheet rear end regulating member 26*a*, regulate them in alignment, and are accumulated in succession upward.

[Sheet Pressing Means]

Figure 8:
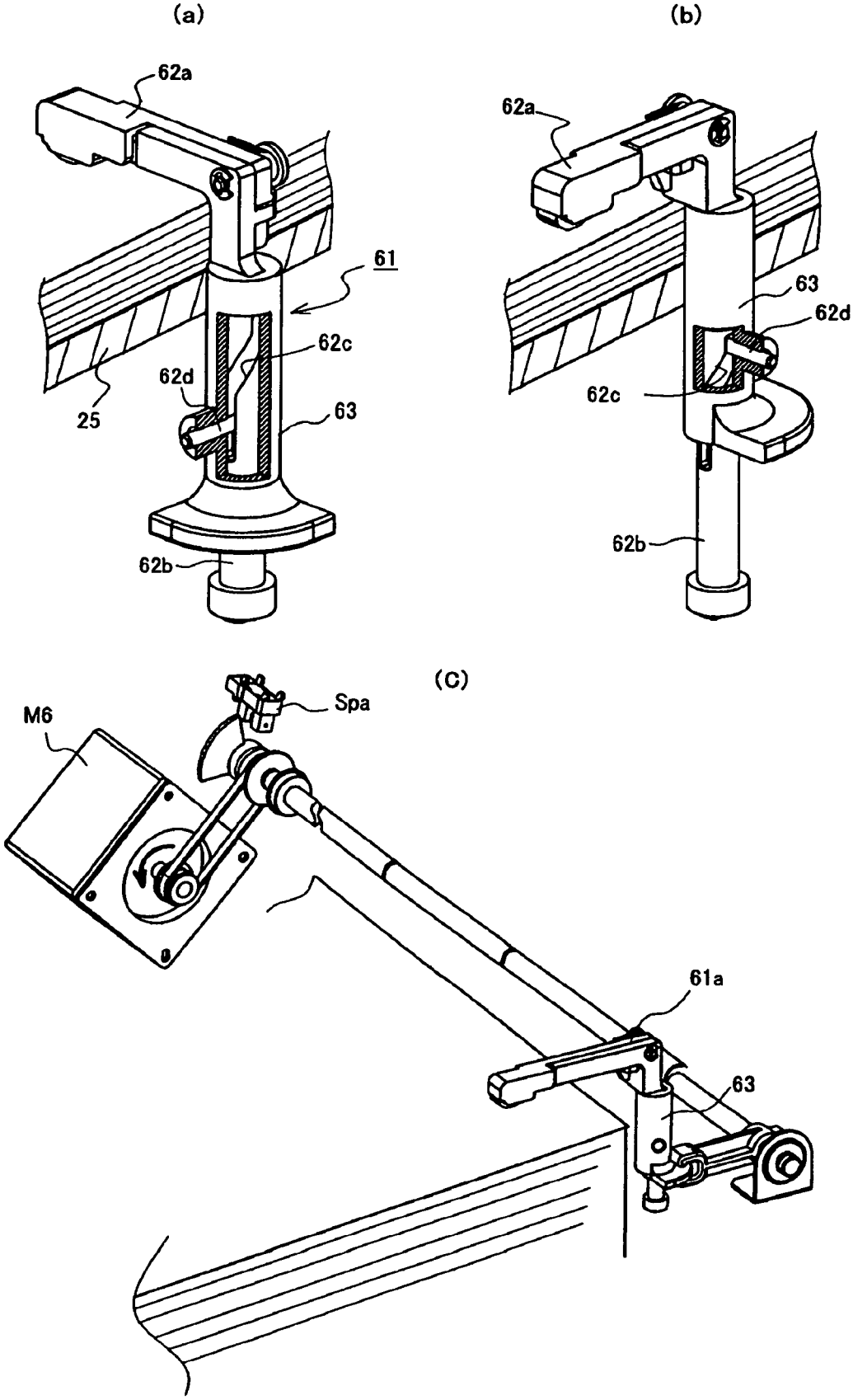
FIG. 8 is the views explaining the sheet pressing means, where (a) shows the condition of pressing to support the sheet side ends, (b) shows the condition being at the retreating position (home position), and (c) shows the whole structural view.

The tray 25 attached to the tray elevating means 31 has a sheet pressing means 61 for pressing to support the loaded sheets. For the sheets loaded on the tray 25, a lateral pair of sheet pressing members 61*a*, 61*b* (generically called as "sheet pressing member 61" hereafter) are disposed to press and support the sheet side ends traversing with the sheet discharging direction, and when dropping the sheets, the sheet pressing member 61 goes back from the upper surface of the tray, and presses down the uppermost sheet after storing the sheets. Therefore, the shown sheet pressing member 61 is composed of an arm shaped sheet contacting piece 62*a* and a cylinder cam 62*b* fixed to the apparatus frame 26. The cylinder cam 62*b* is formed with an inclined cam groove 62*c* for rotating the sheet contacting piece 62*a* following up and down moving. The sheet contacting piece 62*a* has a pin 62*d* fitting in the inclined cam groove 62*c* mounted on the cylinder cam 62*b*, and is fitted in an arm 63 connected with a vertically moving motor M6. Therefore, if driving the motor M6 in an arrow direction in FIG. 8(*c*), the arm 63 pulls upward the sheet contacting piece 62*a*. Then, a pin 62*d* of the sheet contacting piece 62*a* rotates almost 90 degrees by the inclined cam groove 62*c*, and the sheet contacting piece 62*a* turns 90 degrees at the same time with the sheet moving upward from the condition of FIG. 8(*a*) and moves to the retreating position. By the way, "Spa" designates a position sensor of the sheet contacting piece 62*a* for detecting the retreating position as a home position.

[Control of Tray Moving Upward and Downward]

The elevating arm 31 has an upper limit position sensor Sp2 for detecting an upper limit position, a maximum loading position sensor Sp3 for detecting a maximum loading position, and a lower limit position sensor Sp4 for detecting a lower limit position. A later mentioned control means 70 of the elevating motor M3 rotates to drive the elevating motor M3 by detecting signals of the above sensors for moving upward and downward the elevating arm 31. Actuations thereof will be mentioned in detail.

[Installing Structure]

Figure 9:
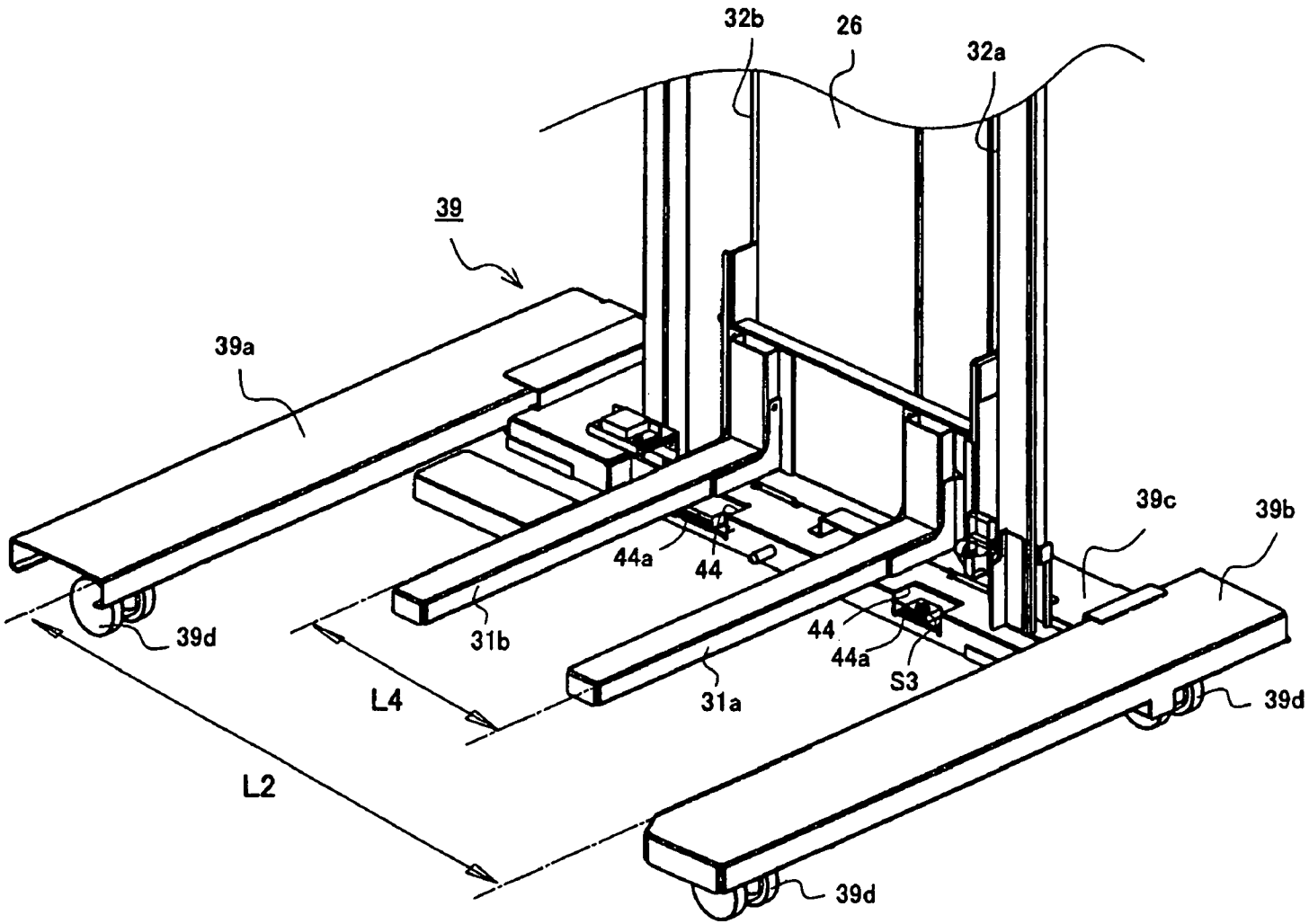
FIG. 9 is the structural view of installing the tray elevating means.

Explanation will be given to the installing structure of the tray elevating means 31, referring to FIG. 9. The guide rails 32*a*, 32*b* are fixedly supported to the installing frame 39 supporting the housing 20 and the apparatus frame 26. The installing frame 39 is structured with rectangular frameworks, where the apparatus front side and a lateral pair of the side frames 39*a*, 39*b* releasing the front side of FIG. 1 are combined by a connecting frame 39*c* of the rear side for bringing in a later mentioned carrier means (carrying truck) from the apparatus front side. Casters 39*d* are provided to the lateral pair of the side frames 39*a*, 39*b* for supporting the whole weight of the sheet accumulation apparatus B. The installing frame 39 has a later mentioned connecting part of the carrier means and an engaging means for preventing connection of the carrier means.

[Carrier Means]

Figure 10:
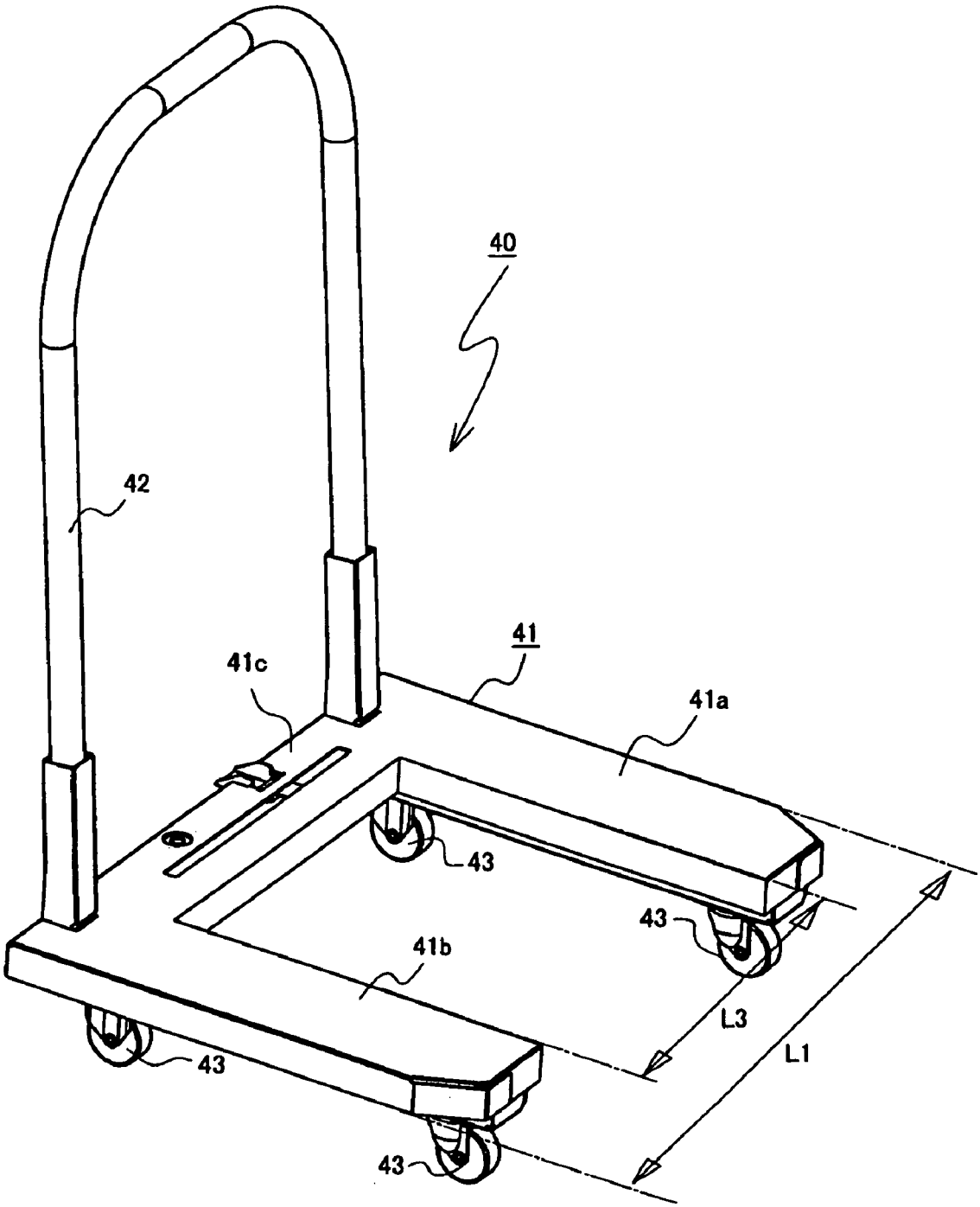
FIG. 10 is the whole perspective view of the carrier means.
Figure 11:
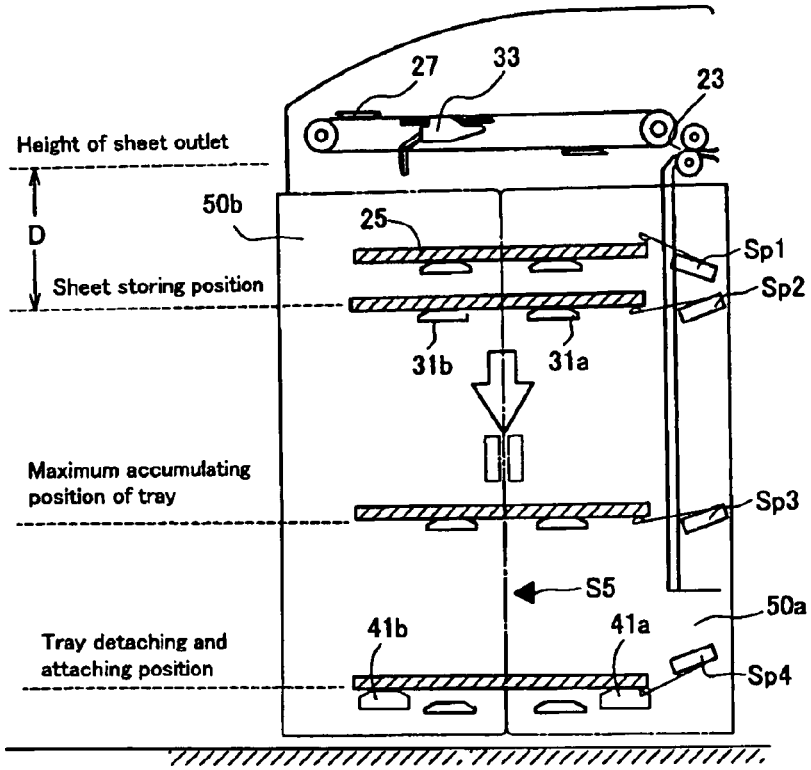
FIG. 11 is the views explaining (a) and (b) of the elevating operations of the tray means, showing the conditions of the tray means loading the sheets.
Figure 11:
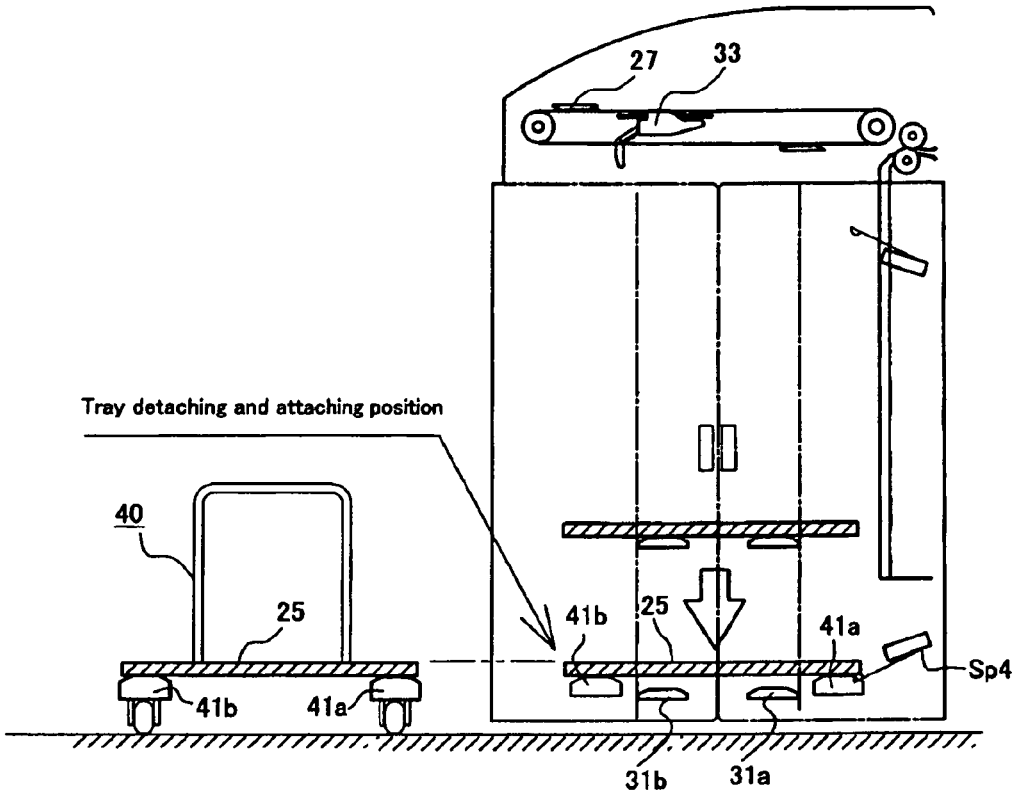

Explanation will be given to the carrier means, referring to FIG. 10. The above mentioned tray 25 is detachably mounted on the tray elevating means (elevating arm 31). The tray is taken over and mounted on the carrier means 40 installed under the elevating member, and taken out from the apparatus. The carrier means 40 is structured with a truck frame 41 and an operating handle 42 fixed thereto. The truck frame 41 is structured in the rectangular shape by securing the lateral pair of forked arm members 41*a*, 41*b* (fork member; the same in the following) as one body via the connecting arm 41*c* having a hand operating handle 42, and the arm member 41 has wheels 43. Accordingly, if manually operating the handle 42, the tray 25 loading the sheets is mounted on the arm members 41*a*, 41*b* and can be carried.

[Positioning Set of the Carrier Means]

The arm members 41*a*, 41*b* of the carrier means 40 are guided between the lateral pair of side frames 39*a*, 39*b* of the installing frame 39 and led into the apparatus housing 20. In short, the external size L1 of the arm members 41*a*, 41*b* is almost equal to the internal size L2 of the side frames 39*a*, 39*b* (L1=L2), and the arm members 41*a*, 41*b* are guided between the lateral pair of side frames 39*a*, 39*b* and advance into the apparatus housing 20. Thus, the side frames 39*a*, 39*b* of the installing frame 39 structures the guide member for guiding the carrier means 40 into the apparatus housing 20. Further, the left and right arms 41*a*, 41*b* are formed to be L3>L4, so that the elevating arms 31*a*, 31*b* are positioned inside thereof in a manner that the former is wider in width (L3), while the latter is narrower in width (L4).

The connecting frame 39*c* of the installing frame 39 is provided with positioning concaves 44 (positioning members) into which projections (not shown) formed in the arm member 41 of the carrier means 40 fit. The positioning concaves 44 are buried with magnet catches 44*a*, and within the catches, there are built detecting sensors S3 made of magnetic sensors (lead sensors). Accordingly, the carrier means 40 is positioned by guiding to the side frames 39*a*, 39*b* of the installing frame 39 and mounting in the positioning concaves 44, and is held by the magnet catches 44*a*. The detecting sensor S3 detects whether or not the carrier means 40 is attached to a predetermined position, and the elevating arm 31 positioning upward goes down.

The sheet discharging operation in the above mentioned apparatus will be explained. When receiving a signal of designating to discharge the sheets from, for example, the image forming apparatus A, the control means 70 of the sheet accumulation apparatus B drives to rotate the sheet discharging means 24 "job starting action". Then, the sheets from the sheet outlet 3 of the image forming apparatus A are guided to the sheet bringing-in course 21. At this time, since the sheet carrying means 28 waits at a position of the gripper member 27 facing the sheet outlet 23, the sheets are kept at the front ends by the nipping pieces 27*a* and held by the moving belt 30 owing to resilience thereof. In case of making the sheet carrying means 28 of the vacuum belt, the sheets are absorbed and held by the belt. The control means 70 rotates to drive the sheet carrying means 28 at the same speed as that of the sheet discharging means 24, and carries the sheets to the tray front side "sheet discharging action". When the sheets collide at the front ends against the stopper member 34 of the sheet front regulating means 33, the sheets sent by the carrier means are stripped from the moving belt 30, and at this time, since the sheet rear ends are discharged from the sheet outlet 23 to the side of the tray, the sheets drop onto the tray "sheet dropping action". When the control means 70 moves the aligning members 54*a*, 54*b* of the sheet side aligning means 54 having in advance waited at the waiting position, the sheets are beaten at the side ends by the aligning member and are aligned for width-end registration "alignment in the sheet with direction".

Before and after the width-end registration of the aligning member 54, the control means 70 causes the driving motor M5 of the sheet rear end pushing-down means 58 to rotate to oscillate the driving lever 60 in the clockwise direction in FIG. 6. Then, a beating piece 58*a* forcibly beats the sheet rear ends "sheet pushing-down action". Prior to this action, the control means 70 has moved the sheet contacting pieces 62*a*, 62*b* of the sheet pressing means 61 to the retreating position. Moving to the retreating position moves the sheet contacting piece 62 to the engaging position of FIG. 8(*a*) by the vertically moving motor M6 "retreating action of the sheet pressing member".

The sheets from the sheet outlet 23 are carried until the tray front end by the sheet carrying means 28, separate from the sheet carrying means 28, and drop onto the tray. When dropping, the sheets are forced to have an attitude in the width direction and rapidly drop by the beating piece 58*a*. Subsequently, the control means 70 actuates the vertically moving motor M6 at a timing when the sheets are stored on the tray, and return the sheet contacting piece 62 at the retreating position to the acting position of pushing the sheets on the tray "sheet pressing action".

By repeating the above mentioned actions, the sheets sent to the sheet outlet 23 are loaded and stored on the tray. When the above mentioned sensor Sp1 of detecting a level of the sheet surface detects the loaded sheets of the predetermined amount, the control means 70 carries down the elevating arms 31*a*, 31*b* to the determined amount. When the elevating arms 31*a*, 31*b* move down to the pre-set maximum loading amount, the control means 70 judges "full". At the time of detecting this "full", or by a job finishing signal from the image forming apparatus A, the control means 70 starts the width-end regulating motor M4 to move the sheet side aligning means 54 to the above mentioned retreating position Z. Then, the rear side aligning member 54*b* retreats to the position enough separating from the sheet side ends, and at the position enough separating from the sheet side ends, the front side aligning member 54*a* retreat, and the front suspending piece 54*a*' of the lower end part retreats above the tray. Therefore, when taking out the sheets on the tray, there is no danger that the sheets of the upper layer contact the aligning member 54*a* and break down the accumulation of the sheets.

What is claimed is:

1. A sheet accumulation apparatus, comprising:

a sheet outlet for successively discharging sheets having images so that stitching margins of the sheets are oriented rearwardly, a tray member disposed under the sheet outlet for holding sheets therein, a sheet carrier member disposed above the tray member for discharging the sheets from the sheet outlet downstream thereof, a sheet front end regulating member for abutting the sheets sent by the sheet carrier member at front ends of the sheets, regulating the sheets and storing the sheets on the tray member, and a sheet rear end regulating member disposed with the tray member for regulating rear end positions of the sheets from the sheet outlet, wherein the sheet front end regulating member is comprised of two or more stopper members which include a first stopper member positioned on an upstream side and a second stopper member positioned on a downstream side in a sheet transferring direction for selectively facing sheet front end regulating positions, a shift member for driving the first and second stopper members, and a control member for controlling the shift member, and wherein the control member has a tabbed sheet discriminating member for discriminating whether or not the sheet from the sheet outlet has a tab projecting from the sheet front end, and when discriminating that the sheet from the sheet outlet has the tab by means of the tabbed sheet discriminating member, the control member causes the first stopper member positioned on the upstream side to retreat from the sheet regulating position, and causes the second stopper member to face the sheet front end regulating position, and when discriminating that the sheet from the sheet outlet does not have the tab by means of the tabbed sheet discriminating member, the control member causes the first stopper member to face the sheet regulating position.

2. A sheet accumulation apparatus as set forth in claim 1, wherein the tabbed sheet discriminating member discriminates the tabbed position in a sheet width direction, the shift member causes the stopper member facing the tabbed position to retreat from the sheet regulating position, and the control member actuates the shift member in accordance with information from the tabbed sheet discriminating member.

3. A sheet accumulation apparatus, comprising:

a sheet outlet for successively discharging sheets having images so that stitching margins of the sheets are oriented rearwardly, a tray member disposed under the sheet outlet for loading and holding the sheets therein, a sheet carrier member disposed above the tray member for discharging the sheets from the sheet outlet downstream thereof, a sheet front end regulating member for abutting the sheets sent by the sheet carrier member at the sheet front ends, regulating them, and storing them on the tray member, and a sheet rear end regulating member for regulating rear ends of the sheets and disposed on the tray member for regulating the positions of the sheets from the sheet outlet, wherein the sheet front end regulating member is comprised of a stopper member movable transversely with respect to a sheet transferring direction along the sheet front ends, a shift member for driving the stopper member, and a control member for controlling the shift member, and wherein the control member has a tabbed sheet discriminating member for discriminating whether or not the sheet from the sheet outlet has a tab projecting from the sheet front end, and when the sheet from the sheet outlet is discriminated as having the tab, the control member controls the shift member to move the stopper member transversely with respect to the sheet transferring direction.

4. A sheet accumulation apparatus as set forth in claim 3, wherein the tabbed sheet discriminating member discriminates the tabbed position in a sheet width direction, the shift member causes the stopper member facing the tabbed position to move in the sheet width direction, and the control member actuates the shift member in accordance with information from the tabbed sheet discriminating member.

5. A sheet accumulation apparatus, comprising:

a sheet outlet for successively discharging sheets having images so that stitching margins of the sheets are oriented rearwardly, a tray member disposed under the sheet outlet for loading and holding the sheets therein, a sheet carrier member disposed above the tray member for discharging the sheets from the sheet outlet downstream thereof, a sheet front end regulating member for abutting the sheets sent by the sheet carrier member at the sheet front ends, regulating them, and storing them on the tray member, and a sheet rear end regulating member disposed with the tray member for regulating the positions of rear ends of the sheets from the sheet outlet, wherein the sheet front end regulating member is comprised of a stopper member movable back and forth in the sheet traversing direction, a shift member for driving the stopper member, and a control member for controlling the shift member, and wherein the control member has a tabbed sheet discriminating member for discriminating whether or not the sheet from the sheet outlet has a tab projecting from the sheet front end, and controls the shift member to move the stopper member orthogonally with respect to a sheet transferring direction.

6. A sheet accumulation apparatus as set forth in claim 1, wherein the tabbed sheet discriminating member decides whether or not the sheet is a tabbed sheet and/or the tab position by means of signals from a plurality of sensors arranged at the upstream side of the sheet outlet, and the sensors are arranged orthogonally with respect to the sheet transferring direction for detecting the tabbed edges and tabbed outer edges.

7. A sheet accumulation apparatus as set forth in claim 3, wherein the tabbed sheet discriminating member decides whether or not the sheet is tabbed sheets and/or the tab position by means of signals from sensors arranged at the upstream side of the sheet outlet, and the sensors are arranged orthogonally with respect to the sheet transferring direction for detecting the tabbed edges and the tabbed outer edges.

8. A sheet accumulation apparatus as set forth in claim 5, wherein the tabbed sheet discriminating member is composed to decide whether or not the sheet is a tabbed sheet and/or the tab position by means of signals from sensors arranged at the upstream side of the sheet outlet, and the sensors are arranged orthogonally with respect to the sheet transferring direction for detecting the tabbed edges and the tabbed outer edges.

9. A sheet accumulation apparatus as set forth in claim 1, wherein the sheet carrier member comprises a vacuum belt member holding the sheet from the sheet outlet at the sheet front end or a grip belt member holding the sheet front end, and the sheet front end regulating member is disposed above the tray member and is comprised of the stopper member for abutting and regulating the sheet sent by the sheet carrier member at the sheet front end.

10. A sheet accumulation apparatus as set forth in claim 3, wherein the sheet carrier member comprises a vacuum belt member holding the sheet from the sheet outlet at the sheet front end or a grip belt member holding the sheet front end, and the sheet front end regulating member is disposed above the tray member and is comprised of the stopper member for abutting and regulating the sheet sent by the sheet carrier member at the sheet front end.

11. A sheet accumulation apparatus as set forth in claim 5, wherein the sheet carrier member comprises a vacuum belt member holding the sheet from the sheet outlet at the sheet front end or a grip belt member holding the sheet front end, and the sheet front end regulating member is disposed above the tray member and comprises the stopper member for abutting and regulating the sheet sent by the sheet carrier member at the sheet front end.

12. A sheet accumulation apparatus as set forth in claim 1, wherein the stopper member is movable in the sheet transferring direction along the sheet carrier member, and the control member controls to move the position of the stopper member in response to length sizes of the sheet from the sheet outlet.

13. A sheet accumulation apparatus as set forth in claim 5, wherein the stopper member is movable in the sheet transferring direction along the sheet carrier member, and the control member controls to move the position of the stopper member in response to length sizes of the sheet from the sheet outlet.

14. An image forming system, comprising:

an image forming member for forming images in succession on sheets, an image forming apparatus having a sheet supply means for supplying the sheets to the image forming member, a sheet discharging path for guiding the sheets discharged from the image forming apparatus to the sheet outlet, and sheet accumulation apparatus for loading to store the sheets from the sheet outlet, and wherein the sheet accumulation apparatus has a structure as set forth in claim 1.

15. An image forming system, comprising:

an image forming member for forming images in succession on sheets, an image forming apparatus having a sheet supply member for supplying the sheets to the image forming means, a sheet discharging path for guiding the sheets discharged from the image forming apparatus to the sheet outlet, and a sheet accumulation apparatus for loading to store the sheets from the sheet outlet, and wherein the sheet accumulation apparatus has the structure as set forth in claim 3.

16. An image forming system, comprising:

an image forming member for forming images in succession on sheets, an image forming apparatus having a sheet supply means for supplying the sheets to the image forming member, a sheet discharging path for guiding the sheets discharged from the image forming apparatus to the sheet outlet, and sheet accumulation apparatus for loading to store the sheets from the sheet outlet, and wherein the sheet accumulation apparatus has the structure as set forth in claim 5.

17. An image forming system as set forth in claim 14, wherein the sheet supply member is provided with sheet classification information as to whether or not the sheet to be supplied to the image forming member has the tab projecting from the sheet front end, and the tabbed sheet discriminating member of the sheet accumulation apparatus discriminates whether or not the sheet from the sheet outlet has the tab on the basis of the sheet classification information.

18. An image forming system as set forth in claim 15, wherein the sheet supply member is provided with sheet classification information as to whether or not the sheet to be supplied to the image forming member has the tab projecting from the sheet front end, and the tabbed sheet discriminating member of the sheet accumulation apparatus discriminates whether or not the sheet from the sheet outlet has the tab on the basis of the sheet classification information.

19. An image forming system as set forth in claim 16, wherein the sheet supply member is provided with sheet classification information as to whether or not the sheet to be supplied to the image forming member has the tab projecting from the sheet front end, and the tabbed sheet discriminating member of the sheet accumulation apparatus discriminates whether or not the sheet from the sheet outlet has the tab on the basis of the sheet classification information.

* * * * *